US006481127B1

(12) United States Patent
Bilbie et al.

(10) Patent No.: US 6,481,127 B1
(45) **Date of Patent: *Nov. 19, 2002**

(54) ERASABLE PRODUCT

(76) Inventors: Clive James Bilbie, 298 Oriental Parade, Wellington (NZ), 6001; Roy Beverly Tipper, 45 The Terrace, Wellington (NZ), 6001

( * ) Notice: Subject to any disclaimer, the term of this patent is extended or adjusted under 35 U.S.C. 154(b) by 0 days.

This patent is subject to a terminal disclaimer.

(21) Appl. No.: 08/980,042

(22) Filed: Nov. 26, 1997

Related U.S. Application Data

(63) Continuation of application No. 08/454,346, filed as application No. PCT/NZ93/00125 on Dec. 15, 1993, now Pat. No. 5,860,235.

(30) Foreign Application Priority Data

| | | |
|---|---|---|
| Dec. 15, 1992 | (NZ) | 245480 |
| Apr. 14, 1993 | (NZ) | 247404 |
| Jun. 17, 1993 | (NZ) | 247918 |

(51) Int. Cl.[7] ..... G09F 3/10

(52) U.S. Cl. ..... 40/299.01; 40/638; 40/594; 283/81; 281/39; 434/410

(58) Field of Search ..... 40/638, 299.01, 40/594; 283/81; 281/39; 434/410

(56) References Cited

U.S. PATENT DOCUMENTS

| | | | | | |
|---|---|---|---|---|---|
| 2,359,195 | A | * | 9/1944 | Berliner et al. | 434/410 |
| 2,608,771 | A | * | 9/1952 | Sparks | 434/410 |
| 2,663,095 | A | * | 12/1953 | Chase | 434/410 |
| 2,818,662 | A | * | 1/1958 | Payne et al. | 434/410 |
| 3,397,468 | A | * | 8/1968 | Cole | 434/410 |
| 3,512,273 | A | * | 5/1970 | Baker, Jr. et al. | 434/163 |
| 3,943,643 | A | * | 3/1976 | Fisher et al. | 434/410 |
| 4,051,609 | A | * | 10/1977 | Boursaw | 434/410 |
| 4,589,685 | A | * | 5/1986 | Lazar | 283/81 |
| 5,249,969 | A | * | 10/1993 | Confalone, Jr. et al. | 434/410 |
| 5,368,489 | A | * | 11/1994 | Confalone, Jr. et al. | 434/410 |
| 5,791,910 | A | * | 8/1998 | Masson et al. | 434/410 |
| 5,855,083 | A | * | 1/1999 | Bilbie et al. | 40/615 |
| 5,860,235 | A | * | 1/1999 | Bilbie et al. | 40/299.01 |

* cited by examiner

*Primary Examiner*—J. J. Swann
*Assistant Examiner*—Andrea Chop
(74) *Attorney, Agent, or Firm*—Gray, Cary, Ware & Freidenrich

(57) ABSTRACT

An erasable product such as an erasable and rewritable label or an erasable sign comprises a base layer and a transparent or translucent upper sheet over the base layer which provides a smooth and wrinkle-free top surface to the product. The upper sheet and base layer are releasably adhesive together under pressure applied manually on the upper sheet such as writing pressure with a blunt stylus, to cause the upper sheet and the base layer to adhere in the localized region of pressure to display the writing in the case of a label. The upper sheet can be moved sufficiently to separate it from the base layer when a user's finger or thumb is wiped across the top surface of the upper sheet. The upper sheet also extends over a wipe-start region where the upper sheet and the base layer are not adhesive together, over which wipe-start region a user's finger or thumb may be placed from which to begin the movement to separate the upper sheet from the base layer.

25 Claims, 10 Drawing Sheets

ERASABLE PRODUCT

This is a continuation of application Ser. No. 08/454,346, filed on Jun. 15, 1995, entitled ERASABLE PRODUCT now U.S. Pat. No. 5,860,235 which is based on PCT/NZ93/00125 filed Dec. 15, 1993.

FIELD OF INVENTION

The invention comprises an erasable product such as an erasable label, sign or similar. The erasable product of the invention may be a separate label, sign or similar or may be an integral part of another product such as a book for example.

BACKGROUND

In many situations a rewritable label is desirable. For example, when a video cassette has been used to record from television, it is typically labelled by writing details of the recorded program on a paper label on the cassette. Blank video cassettes are typically sold with a number of labels shaped to fit on the cassette. However, when the cassette is used again and another item is added to the tape or over-recorded, the details on the label identifying the first recorded item must be crossed out. Soon there is insufficient room to write identifying details on the cassette once the cassette has been used a few times, and in practice users often simply do not bother to label the cassette because of these difficulties. The same labelling problems arise in labelling computer floppy discs for example, folders or files and in various other labelling situations.

Our PCT patent application WO 92/22434 describes a unique erasable and rewritable label consisting of a wax or similar base layer and an upper sheet over the base layer. The label can be written on and erased for reuse by a finger-wipe erasure action.

SUMMARY OF INVENTION

It is an object of the invention to provide an improved or at least alternative form of erasable product such as a rewritable label, a reusable sign or similar.

In broad terms the invention comprises an erasable product, comprising a base layer and an upper sheet extending over the base layer and fixed in relation to the base layer and providing a smooth and substantially wrinkle free top surface to the product, which upper sheet and base layer are sufficiently releasably adhesive together under pressure applied manually on the upper sheet to cause the upper sheet and the base layer to adhere in the localised region of said pressure but to allow the upper sheet to move sufficiently relative to the base layer to separate the upper sheet from the base layer when a users finger or thumb is wiped across the top surface of the upper sheet, the upper sheet also extending over a "wipe-start" region adjacent the base layer in which wipe-start region the upper sheet and the base layer are not adhesive together, over which region a users finger or thumb may be placed to begin said movement to separate the upper sheet from the base layer.

The upper sheet and the base layer may be made non-adhesive together in the wipe-start region by not applying material comprising the base layer beneath the upper sheet in the wipe-start region, or by applying a coating which prevents the upper sheet and base layer from adhering together to the under surface of the upper sheet or the top surface of the base layer in the wipe-start region.

The erasable product may be an erasable and rewritable label or an erasable sign. It may have a contact adhesive applied to the rear surface or a part of the rear surface of the label or sign enabling it to be stuck on to a video cassette, computer disc, folder or any other object or item. Instead of having a rear surface carrying the base layer, the base layer of the label and upper sheet above it could be applied directly and permanently to an item such as the cover of a folder, a phone card, a ruler or any other solid object.

In a form of erasable product of the invention which is an erasable and rewritable label, details are written on the upper sheet for example with a blunt instrument such as a blunt stylus, a pen or pencil (preferably the non-marking end so as not to permanently mark the erasable product) or any hard object. To erase the label a user's finger is wiped under moderate pressure from the "wipe-start" region across the label over the written details on the label, which are thereby erased.

The upper sheet is preferably translucent to enhance the contrast between the colour of the base layer and the balance of the upper sheet. The upper sheet may additionally or alternatively be tinted with a different colour relative to the colour of the base layer, so that in the case of a label for example the label normally appears to have the colour of the upper sheet and when written on the writing appears in the colour of the base layer, or in a colour resulting from the combination of the base layer and upper sheet colour. For example, the base layer may be coloured blue and the upper sheet toned yellow; when pressed or adhered together under localised pressure of writing the writing will appear green in contrast to the balance of the yellow upper sheet. The colours may be luminescent or fluorescent. The upper sheet may also be made luminescent or fluorescent or may be lightly embossed with a pattern or logo for example which may be present as a hologram printed onto the upper sheet.

In one form of erasable product which is an erasable sign, the product comprises a contrasting icon or indicia in or below the base layer which icon or indicia is visible through the upper sheet when pressure is applied manually on the upper sheet for example with a blunt writing instrument to cause the upper sheet and the base layer to adhere, and which is made substantially less visible when a users finger or thumb is wiped across the. top surface of the upper sheet from the wipe-start region adjacent the base layer to separate the upper sheet from the base layer. The base layer may be formed in the shape of the icon or indicia as a positive image of the icon or indicia, or as a negative image, or the icon or indicia may be printed on a surface beneath the base layer as a positive or negative image and the base layer applied over said surface as a clear or substantially clear coating.

In another form of erasable sign similar to that described above and which is used similarly the base layer may be continuous and a coating to which the upper sheet will not adhere may be coated over the base layer i.e. the coating is a negative image of the icon or indicia (but could be a positive image). Such a coating may be applied to the underside of the upper sheet instead of to the top of the base layer.

In another form of erasable sign of the invention an icon or indicia is printed on the upper sheet in a colour such that when pressure is applied manually on the upper sheet for example with a blunt writing instrument to cause the upper sheet and the base layer to adhere the icon or indicia is made substantially less visible, and when a users finger or thumb is wiped across the top surface of the upper sheet from said region adjacent the base layer to separate the upper sheet from the base layer the icon or indicia becomes visible. The icon or indicia may be printed on the underside or top of the upper sheet, as a positive or negative image.

DESCRIPTION OF DRAWINGS

Preferred forms of erasable products of the invention will now be described by way of example and without intending to be limiting as to detail, with reference to the accompanying drawings, wherein.

DETAILED DESCRIPTION OF PREFERRED EMBODIMENTS

Figure 1:
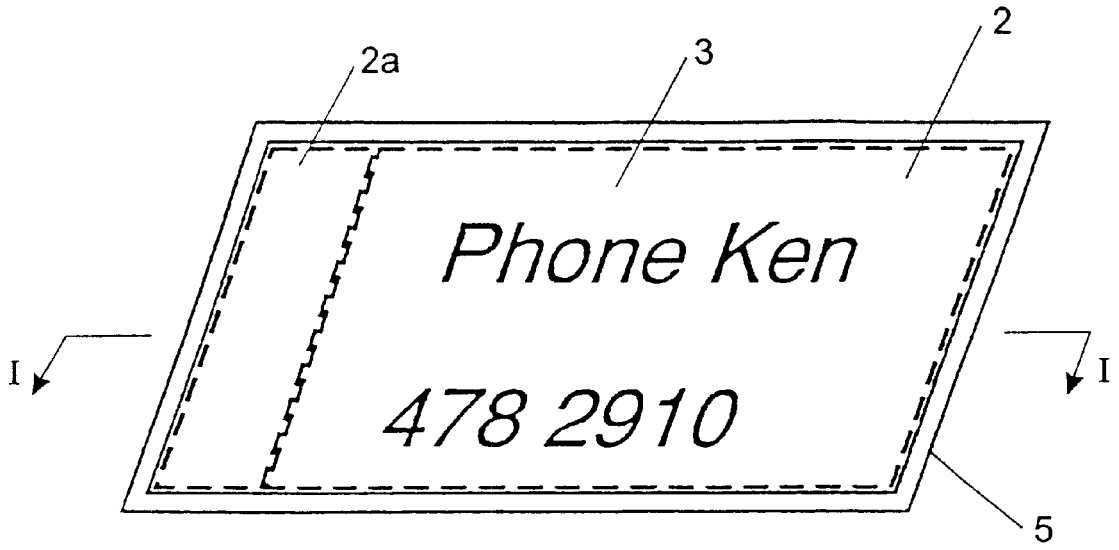
FIG. 1 shows one preferred form of erasable product of the invention which is an erasable and rewritable label.

Referring to the drawings, the erasable product of FIGS. 1 to 4 is an erasable and rewritable label which comprises a base layer 2 and an upper sheet 3 extending over the base layer. The base layer 2 comprises a layer of wax or similar synthetic material which will adhere with the upper sheet 3 as indicated previously. The base layer 2 may be coated onto a backing sheet 5. The base layer is coloured or appears coloured for example dark blue, or alternatively any other desired colour or combination of colours in different regions.

Suitable materials for forming the base layer include waxes such as paraffin wax, blends of paraffin wax with other waxes, blends of other waxes, and other substances such as synthetic wax like substances having a waxy consistency, which can be applied as a thin layer and will adhere with the upper layer. Some base layers such as some synthetic wax-like base layers may be coloured by having a dye added, or alternatively the base layer may be made to appear coloured by printing a colour on a substrate and then applying a clear or near clear wax or similar material over the coloured surface to form a coloured base layer.

The base layer may comprise any other suitable material than wax, which will adhere with the upper sheet 3 under localised manual pressure such as pressure of writing in the case of a label but which also allows the base layer and top sheet to be subsequently separated to erase the label.

The backing sheet 5 which may consist of a layer of light card or paper or plastic or other rigid or non-rigid substrate. The backing sheet 5 may have a coating of contact adhesive 5*a* on its rear surface or a part of its rear surface by which the label may be stuck to an object such as a video cassette as shown, or a folder or the like in other applications. Alternatively the backing sheet may be the page of a book where the label is carried by the page of a child's book as a novelty for example, or a novelty card of a series that children may collect, for example.

It is possible that the material of the backing sheet 5 could form the base layer so that the base layer 2 and backing sheet 5 are one and the same. The base layer 2 can also be directly applied to the surface of an object which is to have a rewritable label permanently fixed to or integral with it, such as a rigid file cover or part thereof, a key ring, an in/out notice board or the like.

The upper sheet 3 is preferably translucent and may comprise a translucent plastic film, tracing paper or the like. A clear plastic film may be given qualities of translucence by etching, texturing or calendaring the film and particularly the bottom surface of the film, for example. This may also assist the upper sheet to adhere with the base layer in use. A clear film may also be made translucent by printing the film with a translucent ink or a layer of a conventional opaque ink which is thin enough to make the film appear translucent. The upper sheet 3 may be printed to define a window in the upper sheet for example through which the written details of the label are visible. Regions of the upper sheet other than such a window may be provided for carrying permanently printed media such as advertising media.

Most preferred for forming the upper sheet are polyester films or similar materials preferably having a glossy or substantially glossy surface. Preferably the upper sheet is up to 100 microns and most preferably in the range 35 to 65 microns in thicknesses.

A protective top sheet (not shown) may be provided over the upper sheet, comprising clear plastic film for example.

Figure 2:
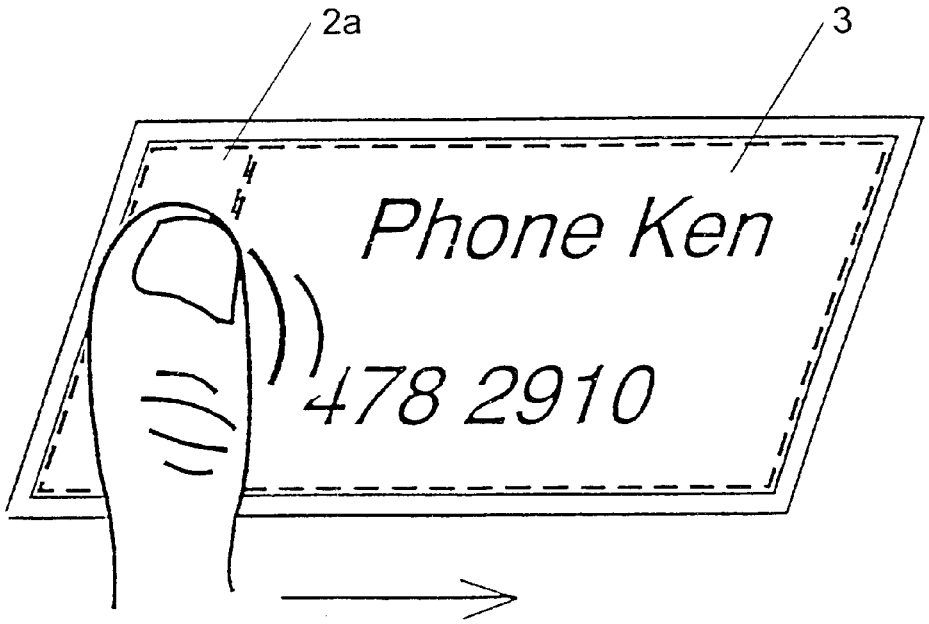
FIGS. 2 and 3 show erasure of the label of FIG. 1.
Figure 3:
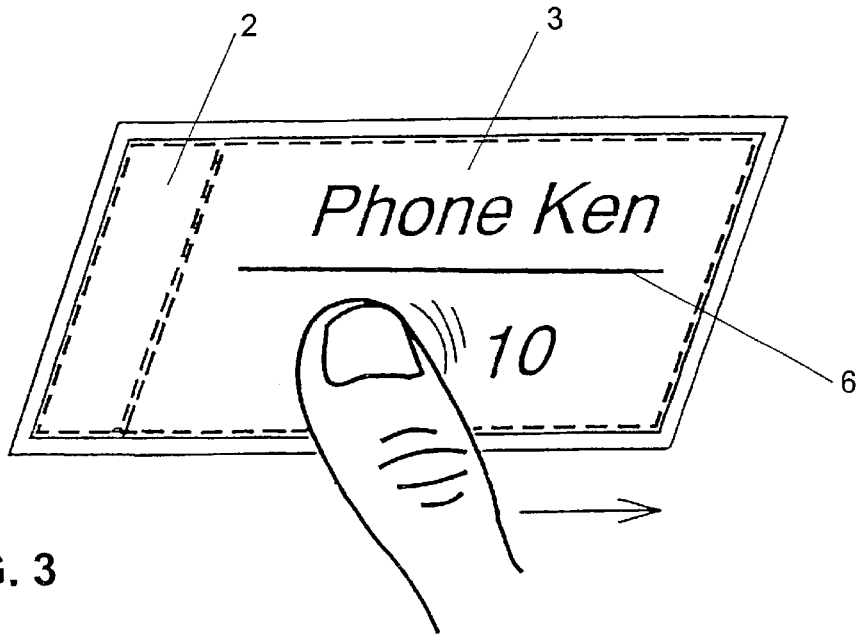
Figure 4:
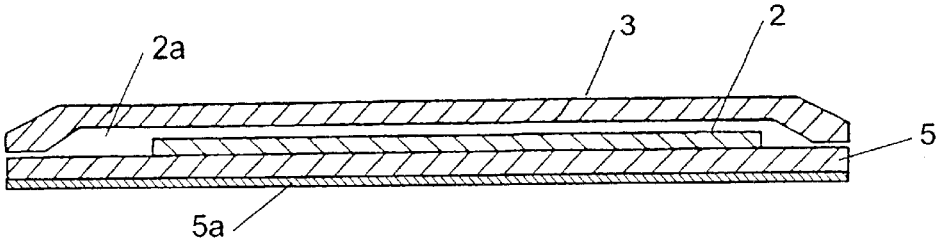
FIG. 4 shows the label of FIGS. 1, 2 and 3 in cross-section along line I—I of FIG. 1.

Adjacent the base layer 2 is provided a wipe-start region 2*a*. In FIGS. 1 to 3 this wipe-start region 2*a* is indicated by a broken outline. The wipe-start region may be formed as shown in FIG. 4 by applying no material of the base layer i.e. no waxy or similar material, to the backing sheet 5 beneath the upper sheet 3 in the wipe-start region 2*a*. The region 2*a* may be the same width across the label as the base layer 2 but could be of less or greater width, and is preferably at least one finger width wide in the direction of erasure along the length of the label, but could be wider, or longer, for larger labels for example.

The upper sheet 3 extends over both the base layer 2 and erase-start region 2*a* and is fixed to the backing sheet 5 about the periphery of the upper sheet, that is along both sides and at either end of the upper sheet, by gluing, plastic welding or other suitable means during manufacture. Alternative to fixing the upper sheet about the entire periphery upper sheet, the upper sheet may be fixed along at least two opposite sides of the upper sheet or at least most of two opposite sides (in the case of a square or rectangular erasable product) but it is preferred to fix the upper sheet about most or all of the periphery of the upper sheet.

The arrangement is such that in use, as shown in FIG. 1, a blunt stylus, a pencil or pen (preferably the non-inking/marking end so as not to permanently mark the label) or any hard object such as even a user's fingernail, may be used to write identifying details on the label by pressing on the upper sheet 3 over the base layer 2. This will cause the upper sheet 3 to adhere to the base layer 2 where localised pressure is applied so that the colour of the base layer is then clearly visible through the translucent upper sheet 3 as shown.

To erase the details from the label a users finger or thumb is placed on the wipe-start region 2*a* and wiped across the top surface of the label from the wipe-start region 2*a*. Even though the top surface of the label is substantially smooth, this will separate the upper sheet 3 and the base layer 2 as the user's finger moves. The label may then be rewritten on as before. As shown in FIG. 3, if a line is drawn between two lines of text, then only one "line" of text may be erased at a time as desired.

Figure 5:
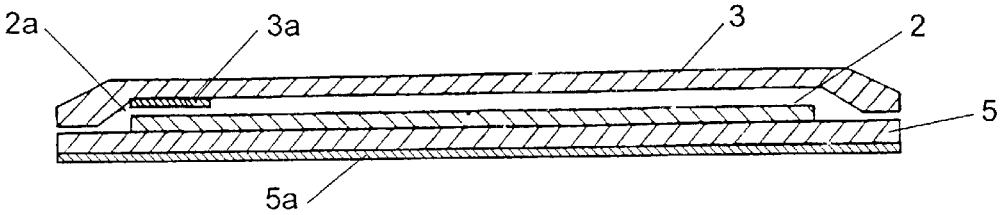
FIG. 5 shows another preferred form of erasable product of the invention which is an erasable and rewritable label similar to that of FIGS. 1 to 4, in cross-section.

FIG. 5 shows in cross-section a label very similar to that of FIGS. 1 to 4, except that in the label of FIG. 5 the material of the base layer 2 extends beneath the upper sheet 3 in the wipe-start region 2*a*, and to make the upper sheet 3 and base layer 2 non-adhesive together in the wipe-start region, a coating 3*b* is applied to the under surface of the upper sheet 3 in the wipe-start region 2*a*. The coating is a material such as a silicon or any other suitable coating, which will make the upper sheet non-adhesive to the material of the base layer 2. The label is used in the same way as the label of FIGS. 1 to 4 i.e. to erase the label a user's finger or thumb is placed on the wipe-start region 2*a* and wiped across the top surface of the label.

Figure 6:
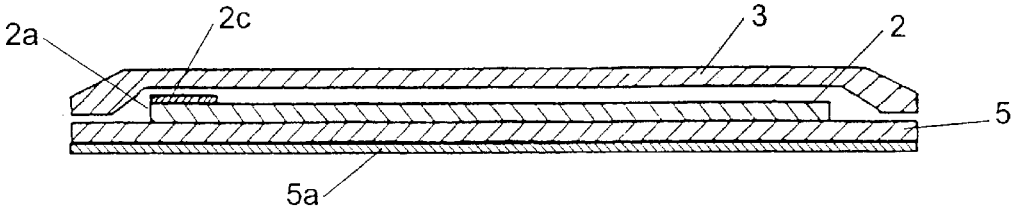
FIG. 6 shows another preferred form of erasable product of the invention which is an erasable and rewritable label similar to that of FIGS. 1 to 4, in cross-section.

FIG. 6 shows another variation similar to FIG. 5 except that a coating 2*c* is applied to the top surface of the base layer 2 in the wipe-start region 2*a*, instead of applying the coating 3*a* to the undersurface of the upper sheet 3. The coating 2*c* has the same effect as the coating 3*a*, in making the upper sheet 3 and base layer 2 non-adhesive together in the wipe-start region 2*a*.

Figure 7:
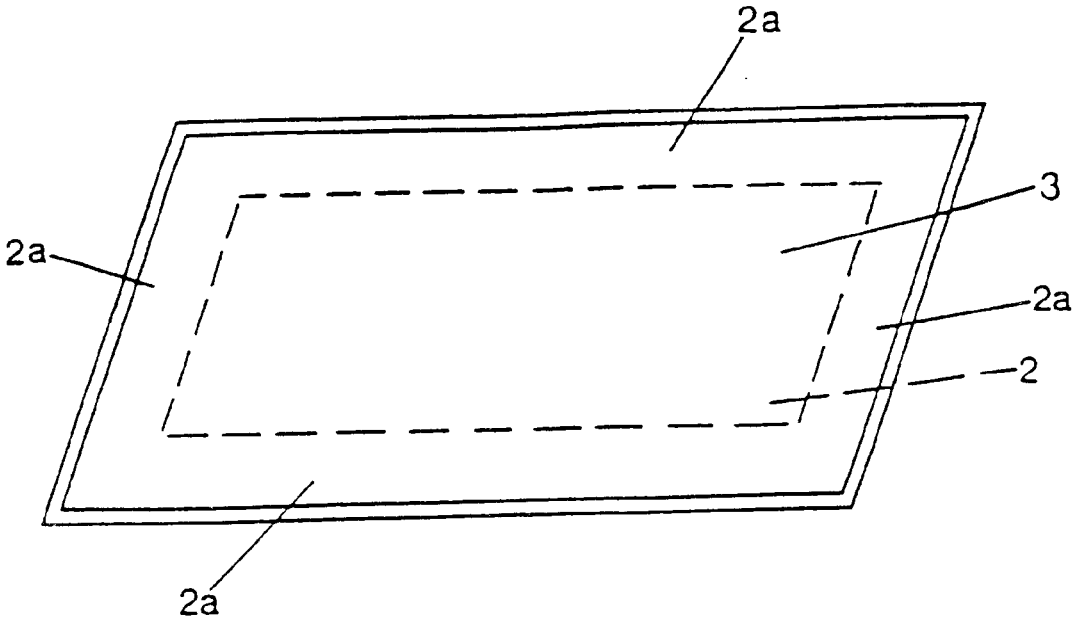
FIG. 7 shows another preferred form of erasable product of the invention which is also an erasable and rewritable label.

FIG. 7 shows another erasable and rewritable label comprising an erasable product of the invention. The label of FIG. 7 may be very similar to the labels of any of FIGS. 1 to 4, 5 and 6 except that in the label of FIG. 7 a wipe-start region 2*a* surrounds the periphery of the base layer 2 as shown. The label is used in exactly the same way as the labels of FIGS. 1 to 4, 5 and 6 except that when erasing the label the wipe erasure action may begin from any part of the wipe-start region 2*a* forming a border for the label.

Figure 8:
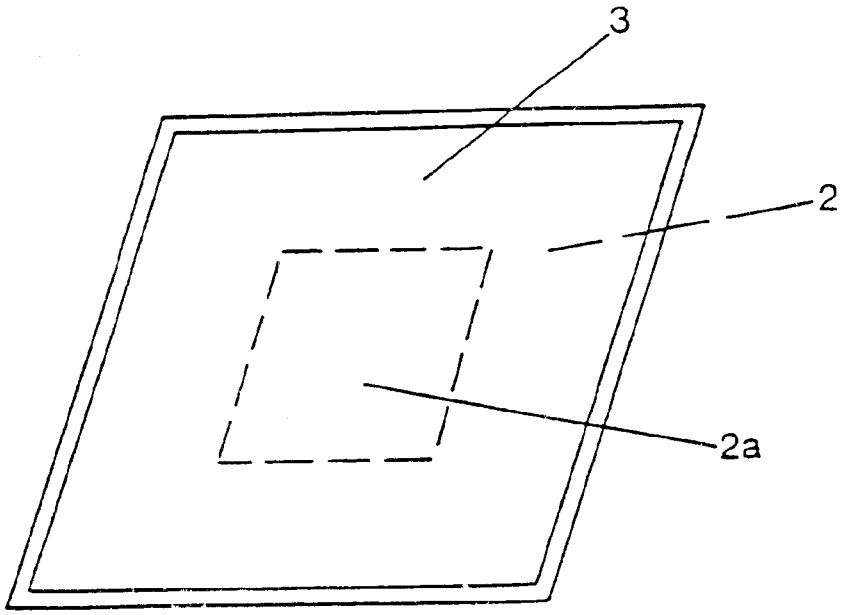
FIG. 8 shows a further preferred form of erasable product of the invention which is another form of erasable and rewritable label.

FIG. 8 shows another label of the invention wherein the wipe-start region 2*a* is placed centrally beneath the upper sheet 3 of the label, rather than about the periphery of the label. In use of the label information may be written on the label as before (except over the wipe start region 2*a*) and the wipe-erasure action is commenced centrally from the wipe-start region 2*a* across to erase any surrounding part of the label.

Other forms of label of the invention may comprise both a central and peripheral wipe-start region. The labels need not be square or rectangular in shape but could be circular in overall shape for example. Numerous variations are possible.

FIGS. 9 to 12 show another preferred form of erasable product of the invention which is an erasable label/sign. Again the erasable sign comprises a base layer 2 and upper sheet 3 which are very similar to the base layer 2 and upper sheet 3 of the label of FIGS. 1 to 4 and may be formed of similar materials. The upper sheet 3 is preferably translucent and may comprise a translucent plastic film. The sign has a similar wipe-start 2*a* beneath a part of the upper sheet 3 as before.

Rather than cover all of the area beneath the upper sheet 3 other than the wipe-start region 2*a*, the base layer consisting of a layer of wax or similar is formed in the shape of an icon or indicia such as the tick shown in the drawings. The icon or indicia instead of being the tick shown could be any other letter, word, number, symbol or the like. The icon or. indicia may be made to have a contrasting colour, for example, by incorporating a dye in the wax of the base layer.

Figure 10:
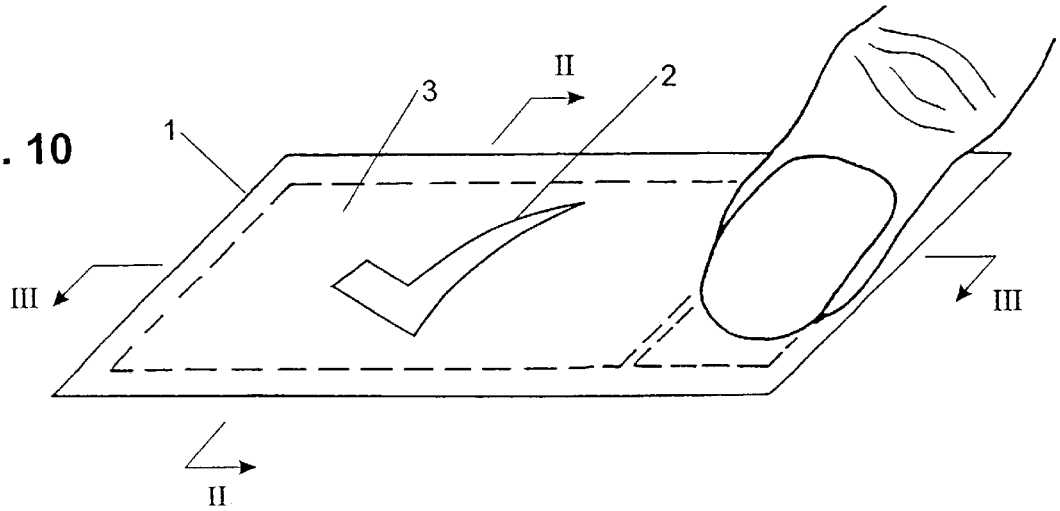
FIG. 10 shows the sign of FIG. 9 with the icon on indicia visible and showing erasure of the icon or indicia.
Figure 11:
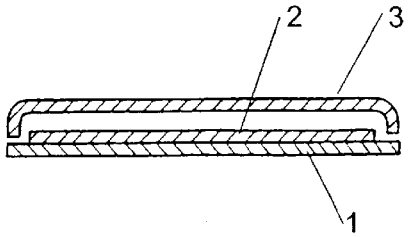
FIG. 11 shows the erasable sign of FIGS. 9 and 10 in cross-section along line II—II of FIG. 10.
Figure 12:
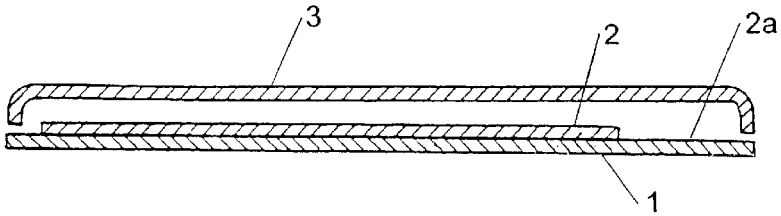
FIG. 12 shows the erasable sign of FIGS. 9 and 10 in cross-section along line III—III of FIG. 10.

In use the upper sheet 3 is pressed down, for example by pressing and repeatedly running a fingernail or stylus over the upper sheet 3 to block or scribble in the required area. This will cause the upper sheet 3 to adhere to the base layer icon or indicia 2 so that the icon or indicia is then clearly visible through the translucent upper sheet 3, as shown in FIG. 10.

Figure 9:
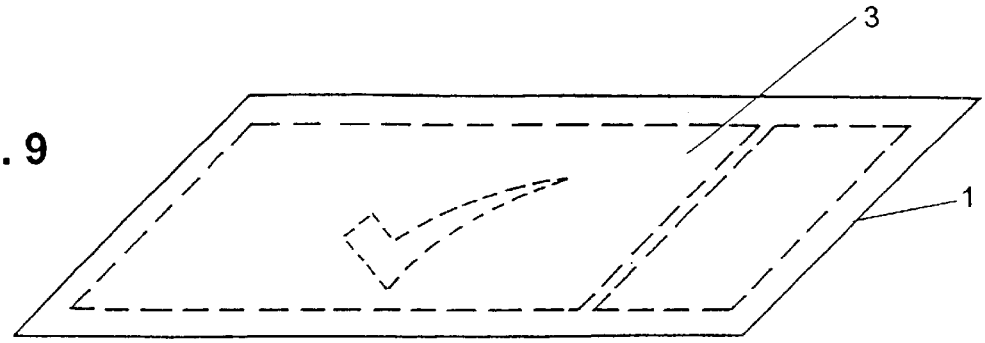
FIG. 9 shows another preferred form of erasable product of the invention which is an erasable sign, showing in FIG. 7 an icon or indicia of the sign not visible.

To erase the icon or indicia so that it is no longer visible, a user's finger or thumb is wiped across the top surface of the upper sheet 3 from the wipe-start area 2*a* in the same way as to erase written information from the labels of FIGS. 1 to 4, 5 and 6. This will separate the upper sheet 3 from the base layer 2, making the icon or indicia substantially invisible. In FIG. 9 the tick is shown in phantom outline for illustrative purposes only.

Instead of the base layer 2 being formed in the shape of the desired icon or indicia as shown in FIGS. 9 to 12, the icon or indicia may be ink printed beneath the base layer and the base layer may then comprise a coating of clear or near clear wax or similar over the whole of the backing sheet, except the wipe-start region 2*a*. When the upper sheet is pressed against the base layer-the upper sheet will adhere to the base layer and the ink printed icon or indicia behind the base layer will become visible through the upper sheet. The sign is erased as before. As before, the backing sheet may have a coating of contact adhesive on its rear surface by which the sign may be stuck to an object in use.

To assist in making the icon or indicia less visible when the upper sheet 3 is not adhered to the base layer 2 colour of the icon or indicia may be made only medium contrast rather than high contrast, and also the top side or under side of the upper sheet 3 may have printed onto it a pattern of small dots or wavy lines or similar which will tend to hide any shadowy image of the icon or indicia that may still be visible through the upper sheet. Such a pattern of dots or wavy lines or similar should not be sufficiently dense or large to obscure the icon when the upper sheet is pressed to adhere to the base layer 2 to make the icon visible. Such a pattern of dots or wavy lines or similar may be printed with a translucent ink, or even with an opaque ink where the pattern is not too dense.

Figure 13:
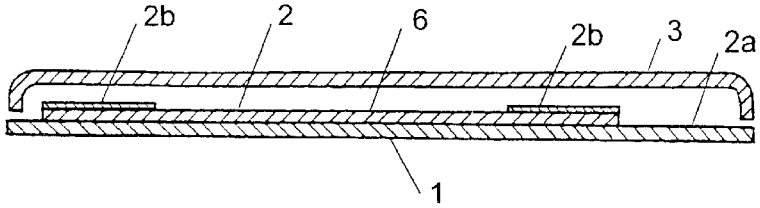
FIG. 13 shows another preferred form of erasable product of the invention which is a form of erasable sign similar to that of FIGS. 9 to 11, in cross-section.

FIG. 13 shows a preferred form of erasable product of the invention which is an erasable label/sign similar to that of FIGS. 9 to 12 in that an icon or indicia is visible when the upper sheet 3 is pressed down for example by pressing and repeatedly running a fingernail or stylus over the upper sheet 3 to block or scribble in the required area, and is erased so as to be no longer visible when a users finger or thumb is wiped across the top surface of the upper sheet 3 from the wipe-start area 2*a*. However, in the erasable product of FIG. 13 the coloured base layer 2 is continuous (other than in the wipe-start region 2*a*) and a coating 2*b* is applied over the top of the base layer 2 except in a region defining the shape of the icon 2 i.e. the coating is applied as a negative image of the icon on top of the base layer 2 (but the coating 2*b* could also be applied as a positive image). When the upper sheet 3 is pressed down by running an object over the upper sheet 3 the upper sheet 3 will adhere to the base layer where the coating 2*b* is not applied but will not adhere to the coating 2*b* so that the icon or indicia will be visible through the upper sheet. To erase the icon or indicia so that it is no longer visible a user's finger or thumb is wiped across the top surface of the upper sheet 3 as before.

In the erasable products of FIGS. 9 to 13 the wipe-start area 2*a* is formed by the upper 3 extending over an area adjacent the base layer 2 to which material of the base layer 2 is not applied, but it could also be formed by continuing the base layer 2 beneath the upper sheet 3 in the wipe-start area and providing a coating to the under surface of the upper sheet, such as the coating 3*a* in FIG. 5, or to the top surface of the base layer 2 in the wipe-start area, such as the coating 2*c* in FIG. 6.

FIGS. 14 to 17 show another preferred form of erasable product of the invention which is another form of erasable sign. Again, the sign comprises a base layer 2 of wax or similar carried for example by a backing sheet 1, and an upper sheet 3. In this form an icon or indicia is printed on the upper sheet 3, which is shown in the drawings as a tick printed on the underside of the upper sheet 3 as a positive image—see FIGS. 16 and 17 at 6. Alternatively the area around the icon on indicia such as the tick may be printed so that the icon or indicia appears as a negative image, i.e. the icon or indicia itself remains as the translucent material with the icon or indicia possibly being given a tint of for example yellow or orange by printing (without loss of the translucent quality). The icon or indicia may be printed on the top side or underside of the upper sheet 3.

Figure 14:
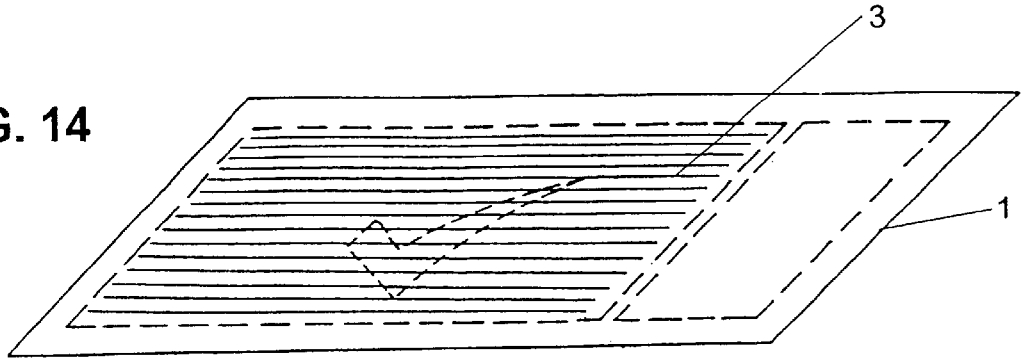
FIG. 14 shows a further preferred form of erasable product of the invention which is another form of erasable sign with the icon or indicia of the sign visible.

To cause the icon or indicia such as the tick to disappear, the upper sheet 3 is pressed against the backing sheet, for example by pressing and repeatedly running a fingernail or suitable stylus over the upper sheet to block or scribble in the required area. This will cause the upper sheet 3 to adhere to the base layer 2 and the icon or indicia will then merge into the colour of the base layer where the icon or indicia has been printed as a positive image, or the colour of the base layer will become visible through the icon or indicia when printed as a negative (translucent) image so that the entire area about the icon or indicia will be blocked out, in a dark colour if the base layer is also a dark colour for example, as shown in FIG. 14. In FIG. 14 the icon or indicia which is a tick is shown in phantom outline for explanatory purposes.

Figure 15:
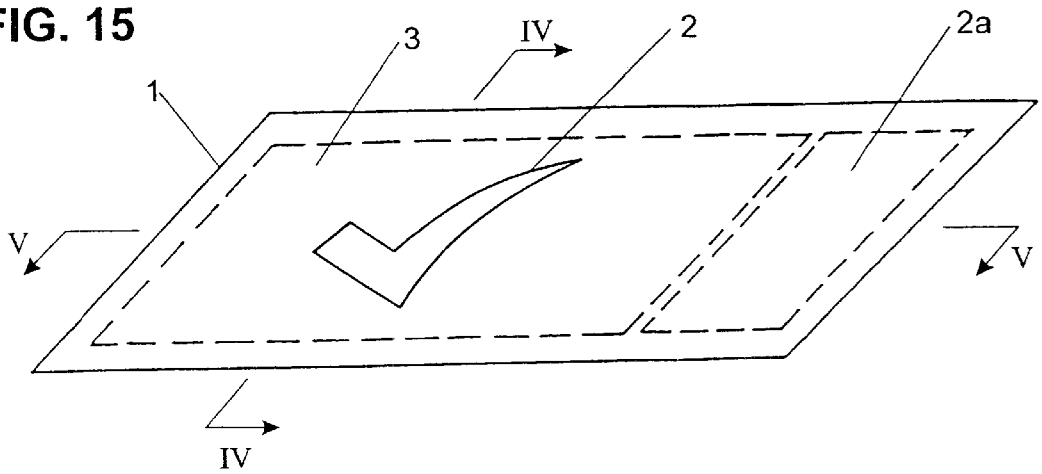
FIG. 15 shows the erasable sign of FIG. 14 with the icon or indicia visible and showing the start of wipe action of the sign visible to make the icon or indicia.
Figure 16:
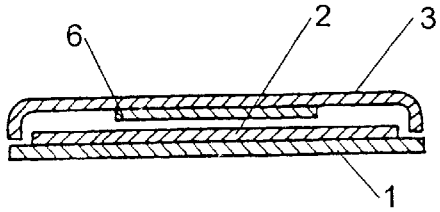
FIG. 16 shows the erasable sign of FIGS. 14 and 15 in cross-section along line IV—IV of FIG. 15.
Figure 17:
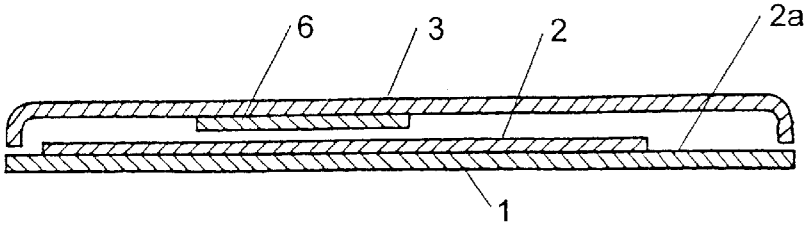
FIG. 17 shows the erasable sign of FIGS. 14 and 15 in cross-section along line V—V of FIG. 15.

To cause the icon or indicia to appear, a user's finger or thumb is wiped across the sign in the same way as previously described, as shown in FIG. 14. This will separate the upper sheet 3 and the base layer 2 as the user's finger moves, so that the icon or indicia will again become visible, as shown in FIG. 15.

Figure 18:
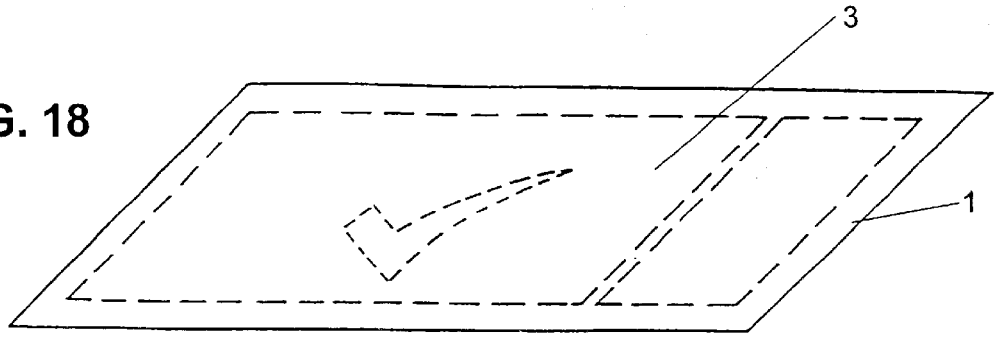
FIG. 18 shows another form of erasable product of the invention which is another form of erasable sign with the icon or indicia not visible.
Figure 19:
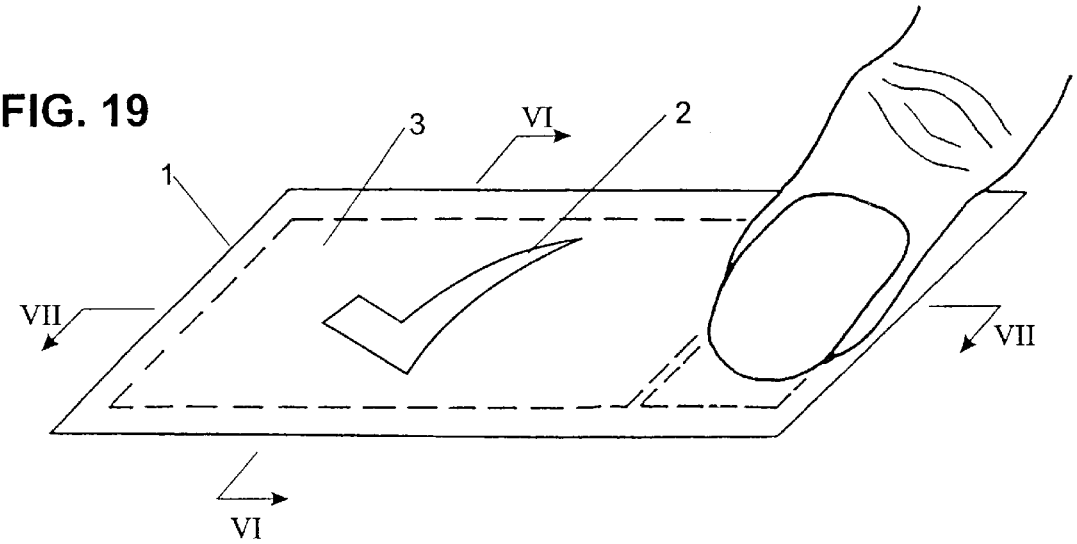
FIG. 19 shows the erasable sign of FIG. 18 with the icon or indicia visible and showing the start of wipe action to make the icon or indicia of the sign not visible.
Figure 20:
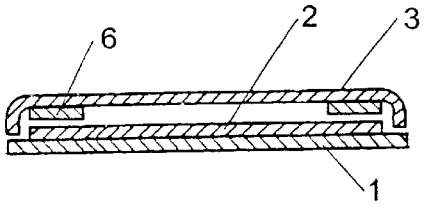
FIG. 20 shows the erasable sign of FIGS. 18 and 19 in cross-section along line VI—VI of FIG. 19.
Figure 21:
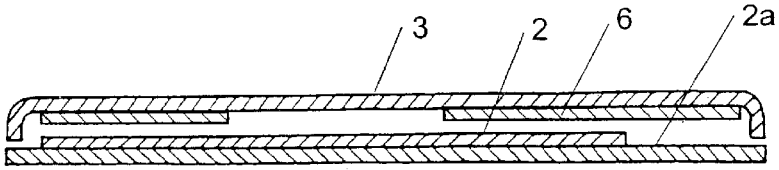
FIG. 21 shows the erasable sign of FIGS. 18 and 19 in cross-section along line VII—VII of FIG. 19.

FIGS. 18 to 21 show yet another preferred form of erasable product of the invention which is another form of erasable sign. Again, the sign comprises a base layer 2 of wax or similar carried for example by a backing sheet 1, and an upper sheet 3. In this form an icon or indicia is printed as a negative image on the upper sheet 3, preferably on the under side of the upper sheet 3. An icon or indicia is shown in the drawings as a tick printed on the under side of the upper sheet 3 as a negative image—see FIGS. 20 and 21. To cause the icon or indicia to appear, the upper sheet 3 is pressed against the backing sheet, for example, by pressing and repeatedly running a fingernail or suitable stylus over the upper sheet. This will cause the upper sheet 3 to adhere to the base layer 2 so that the colour of the base layer will appear through the upper sheet 3 where it is not printed with the layer 6, to form the icon or indicia, as shown in FIG. 19. To cause the icon or indicia to disappear, a user's finger or thumb is wiped across the sign in the same way as previously described, from the wipe-start region 2*a*. This will separate the upper sheet 3 and the base layer 2 as the user's finger moves, so that the icon or indicia will become invisible, as shown in FIG. 18. Preferably the image 6 is printed with a colour which is only a medium contrast with the colour of the base layer 2, such as a lighter grey if the base layer is a dark grey or a lighter red if the base layer is a darker red, to assist in making the icon more invisible when erased. Also as mentioned previously, a pattern which will tend to obscure the icon image i.e. the colour of the base layer through the upper sheet 3 when the icon has been erased, may be printed on to the upper sheet 3, for example on to the top surface, such as a pattern of translucent dots or wavy lines or similar.

FIGS. 22 to 25 show an erasable product of the invention for labelling videos, which consists of both an erasable rewritable label part and an erasable sign part. The erasable sign part of the erasable product is similar in operation to that of FIGS. 14 to 17.

Figure 23:
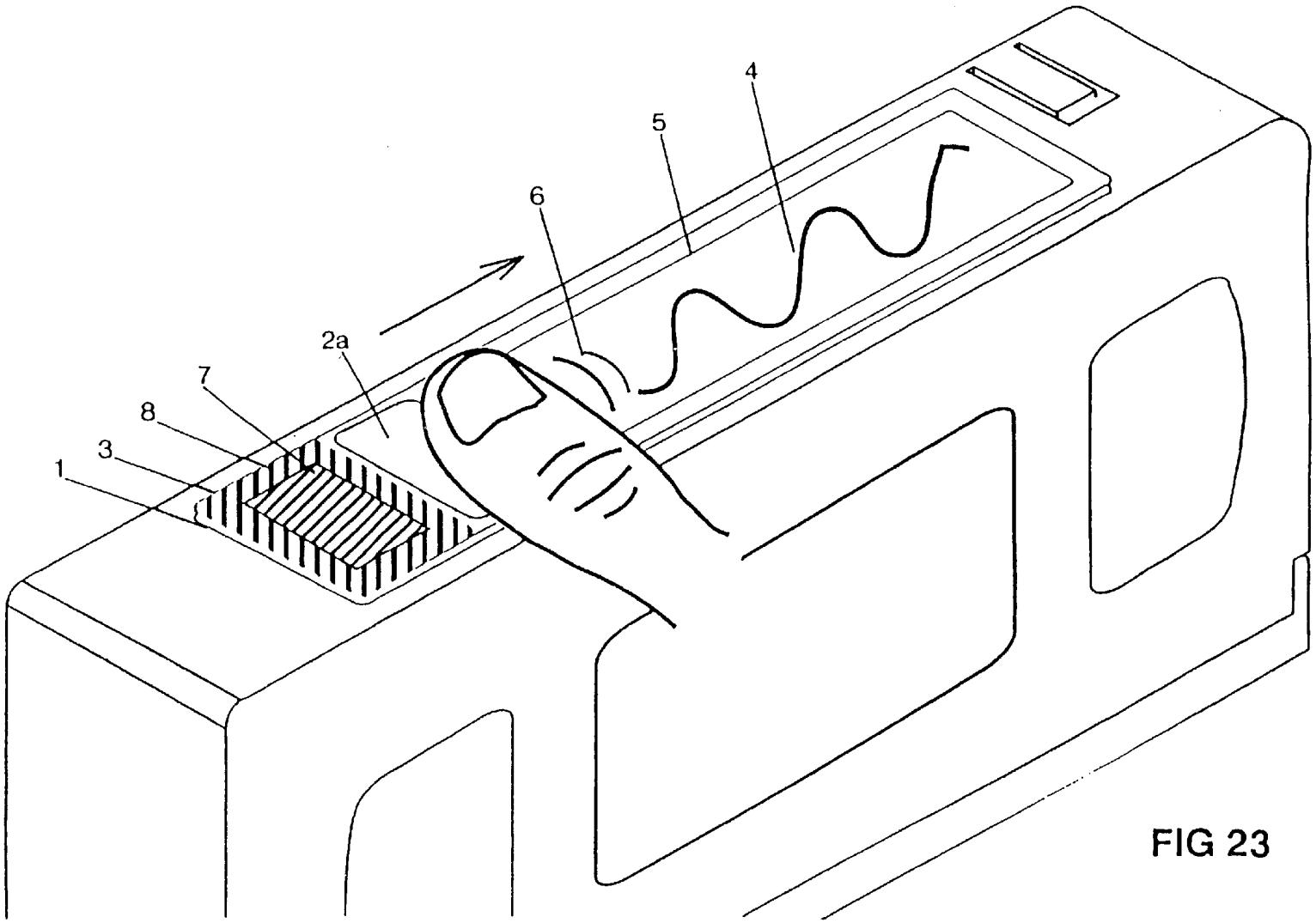
FIGS. 23 and 24 show erasing of the erasable label part of the video label of FIG. 22.
Figure 24:
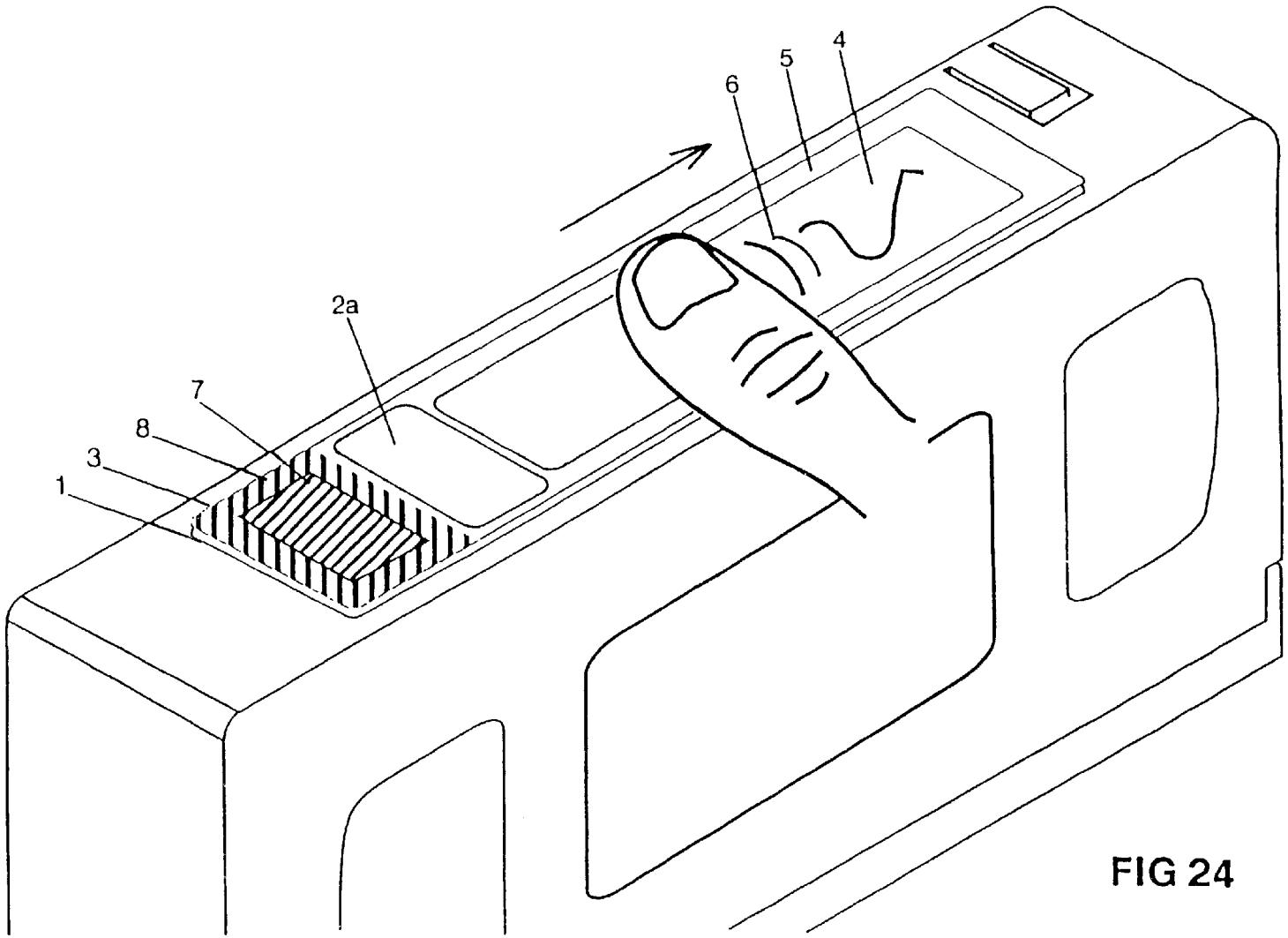
Figure 25:
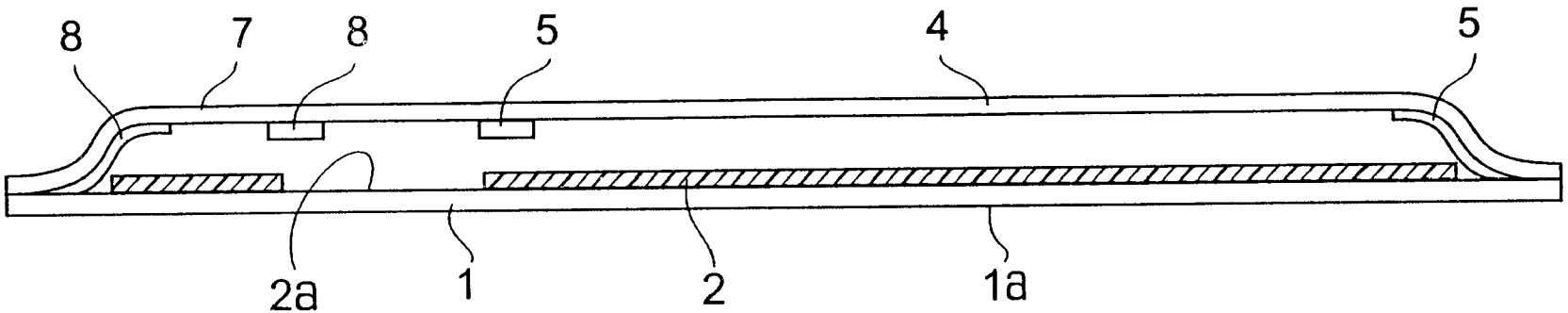
FIG. 25 shows the video label of FIGS. 22 to 24 in longitudinal cross-section.

Referring to FIGS. 22 to 25, the video label comprises a base sheet or backing sheet 1 and an upper sheet 3. A base layer 2 consisting of a layer of wax is carried by the backing sheet 1. The backing sheet 1 has a contact adhesive 1*a* on its rear surface by which the label may be stuck to the spine of a video cassette as shown. The upper sheet 3 comprises translucent film and is fixed to the backing sheet 1 about the entire periphery of the upper sheet (or most of the periphery), that is along both sides and at either end of the upper sheet in the case of a rectangular label, by gluing, plastic welding or other suitable means during manufacture. No base layer is applied to a part of the backing sheet to form a wipe-start region 2*a* as shown in FIG. 25, and also in FIGS. 22 to 24.

Figure 22:
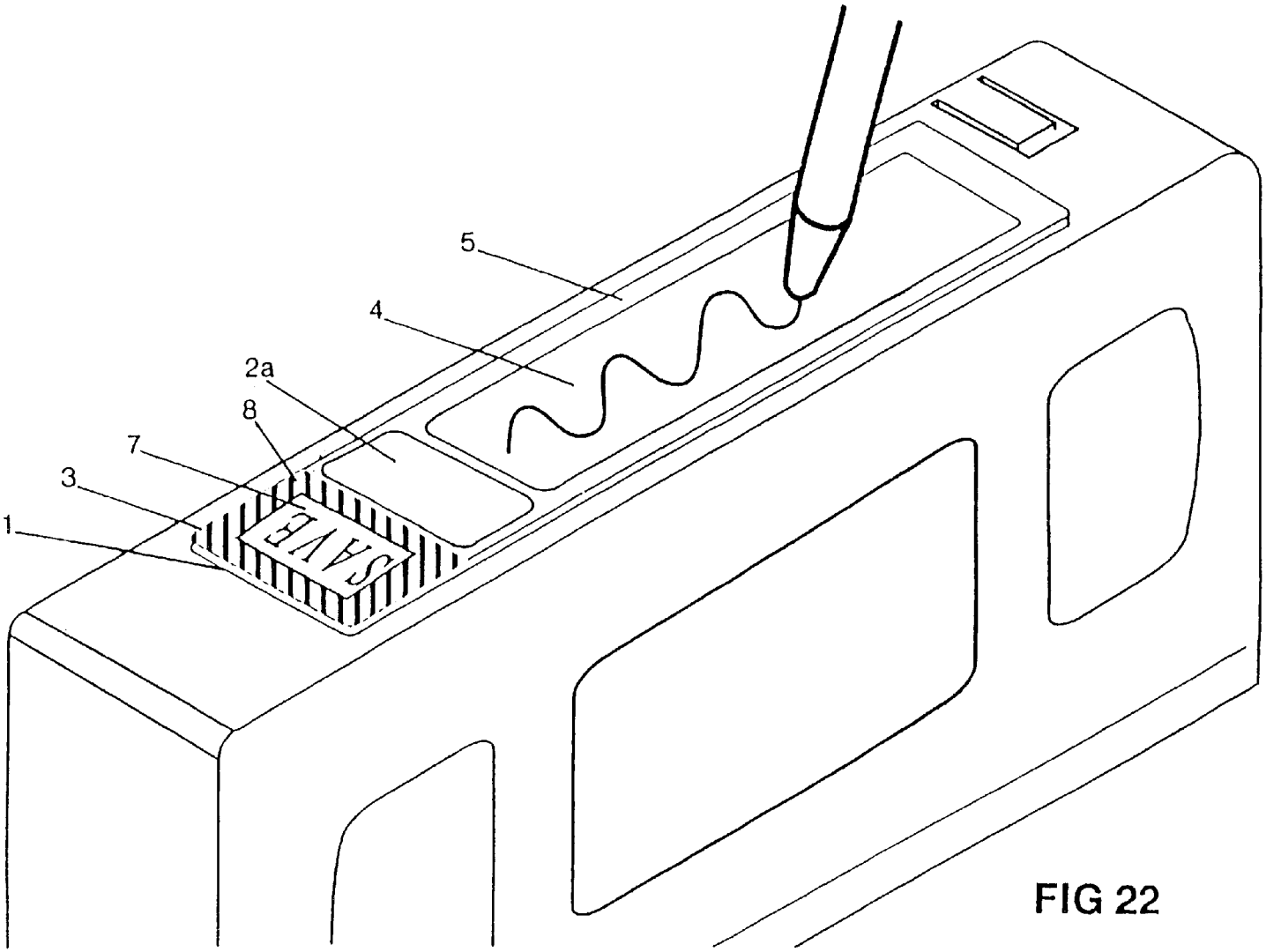
FIG. 22 shows another preferred form of erasable product of the invention which is a video label comprising both an erasable and rewritable label and an erasable sign.

The operation of the rewritable section of the label is the same as for the label of FIGS. 1 to 4. The rewritable label section is defined by a window 4 in the upper sheet. The window 4 may be defined by printing a coloured border 5 on the top sheet about the window 4 or similar. A blunt stylus, a pencil or pen, or the like may be used to write identifying details on the label by pressing on the upper sheet 3 within the window 4 as shown in FIG. 22. This will cause the upper sheet 3 to adhere to the base layer 2 where localised pressure from the writing is applied so that the colour of the base layer is then clearly visible through the upper sheet 3 in the window 4, as shown. The thus labelled video cassette may be used in a video player/recorder, stored or otherwise handled and the identifying details on the label will remain. The thickness of the label is small and does not interfere with the video recorder/player mechanism.

To erase the details from the rewritable window 4 of the label a users finger or thumb is wiped across the label as shown in FIGS. 22 and 23, starting from the wipe-start region 2*a*, to separate the upper layer 3 and the base layer 2. The rewritable portion of the label i.e. the rewritable window 4, may be repeatedly rewritten and erased many times over the life of the label.

A second window 7 is defined by a printed border 8 (see also FIG. 25). An icon or indicia is printed on the upper sheet which in the preferred form shown in the drawings is the word SAVE. The word SAVE may be printed as a positive image in a colour similar to the colour of the base layer 2, as referred to previously. Alternatively the area around the word SAVE may be printed so that the word SAVE appears as a negative image i.e. the word itself remains as the translucent material with the word possibly being given a tint of for example yellow or orange by printing (without loss of the translucent quality).

To cause the SAVE message to disappear the upper sheet 3 is pressed against the backing sheet 1 in the area of the window 7, for example by pressing and wiring a fingernail or suitable stylus over the window 7 to block in the required area. This will cause the upper sheet 3 to adhere to the base layer 2 and the word SAVE will then merge into the colour of the base layer where the word has been printed as a positive image, or the colour of the base layer will become visible through the word SAVE when printed as a negative (translucent) image so that the entire window 7 will be blocked out, in a dark colour if the base layer is also a dark colour for example, as shown in FIGS. 23 and 24.

To cause the SAVE message to appear, a users finger or thumb is wiped across the window 7 from the wipe-start region 2*a* in the same way as previously described, to erase the sign window 4. This will separate the upper layer 3 and the base layer 2 as the user's finger moves, so that the message SAVE will again become visible. The border 8 is printed in a colour relative to the base layer colour such that the border 8 will preferably be visible at all times.

While the preferred forms of erasable products of the invention described with reference to the drawings have an adhesive rear surface, it is possible that they could be integrally formed onto the back of a video cassette, a computer disc, or surface of another item or object such as a book page or card or similar. The base layer could be applied directly to the surface of the item and the upper sheet fixed to the body of the item over the base layer and adjacent wipe-start region by adhesion or by plastic welding or the like about the edges of the label.

Erasable products of the invention are preferably formed as a sealed unit thereby preventing the ingress of contaminates and improving mechanical robustness and structural integrity of the label. However, small air vents 3*a* (see FIGS. 1–3) may be provided in the form of one or more pinholes near the periphery of product such as at either end for example, which can assist in easy erasure of the product, and also as mentioned the upper sheet does not necessarily need to be fixed to the base layer about the entire periphery of the base layer so long as it is fixed along at least most of two opposite sides. The wiping action employed in use assists in redistributing the wax or other material of the base layer into any cavities formed by localised pressure during writing thus extending the life of the erasable product.

An erasable product of the invention could be made up of a number of separate segments each comprising an area of base layer material and adjacent the wipe-start region.

The erasable product may incorporate a hologram for decorative purposes.

Part of the erasable product may be formed of a temperature or moisture sensitive material which will change colour above or below a certain temperature or humidity level to indicate to a user that a computer disc, for example, should not be used. Alternatively a section of such material could be formed in a window elsewhere on the body of the product.

The erasable product of the invention may comprise a label particularly for label video cassettes and can be erased and rewritten many times. Such a label answers the need for a video cassette label which can be repeatedly rewritten and erased. The label may be manufactured in bulk cheaply in continuous strips of side by side labels for example. The case of the video cassette does not need to be modified in any way to accommodate the label. The label does not interfere with the video player/recorder mechanism.

Preferably in manufacture of erasable products of the invention, the upper sheet 3 is applied to the base layer with little tension or minimal tension in the material forming the upper sheet (but without excess slack in the upper sheet). For example, while the upper sheet may be subjected to slight tension in the manufacturing process which will take up some of any inherent elasticity in the material of the upper sheet, it is undesirable for the material to be put under such tension as will take up most of the inherent elastic extension that may be available with the material. Also, it is desirable that the upper sheet be laid onto the base layer without excess air between the base layer and the upper sheet, but at the same time air does not need to be evacuated from between the upper sheet and the base layer.

The following example further illustrates the invention.

EXAMPLE

Labels were made up as follows. To the top surface of a commercially available paper having a contact adhesive coating on its rear surface, was applied a thin coating of wax. The wax consisted of a blend about 75% by weight of a microcrystalline MOBILWAX CERESE and about 25% of a fully refined paraffin wax with a melting point of about 135° F. The blended wax was allowed to set. The wax was applied by wiping a block of the wax over the paper surface. This deposited a film of wax on the top surface of the paper, believed to be of about 10 microns thickness and of dimensions 80×60 mm. An upper layer consisting a film of polyester of 40 microns thickness was placed over the wax and an erase-start region immediately adjacent the wax layer of dimensions 20×60 mm. The label was of overall dimensions 106×66 mm and in peripheral regions the polyester upper layer was glued about the entire periphery of the label with a thin beading of glue 3 mm wide. The labels were tested repeatedly and were all found to operate satisfactorily.

The foregoing describes the erasable product of the invention and preferred forms thereof. Alterations and modifications and combinations of features not specifically described as will be obvious to those skilled in the art are intended to be incorporated within the scope hereof as defined in the accompanying claims.

What is claimed is:

1. An erasable product comprising a base layer and an upper sheet extending over the base layer and fixed to a backing sheet carrying the base layer about the periphery of the upper sheet, the upper sheet and the base layer being sufficiently releasably adhesive together under pressure applied manually on the upper sheet to cause the upper sheet and the base layer to adhere in a localized region of said pressure, the upper sheet also extending over a wipe-start region adjacent the base layer in which said wipe-start region, the upper sheet material, and the base layer are not adhesive together, wherein a user's finger or thumb can be wiped across a top surface of the upper sheet from said wipe-start region to create a wrinkle in the non-adhesive wipe start region and then move the wrinkle from the wipe-start region across the top surface of the upper sheet from a first side to a second side of the upper sheet to separate the upper sheet from the base layer.

2. An erasable product according to claim 1, wherein material comprising the base layer is not provided beneath the upper sheet in said wipe-start region to form the wipe-start region in which the upper sheet and base layer are not adhesive together.

3. An erasable product according to claim 1, wherein the base layer extends beneath the upper sheet in said wipe-start region and a release coating is applied to an under surface of said upper sheet or to a top surface of the base layer in the wipe-start region to form the wipe-start region in which the upper sheet material and the base layer are not adhesive together.

4. An erasable product according to claim 1, wherein the base layer has a color which is visible through the upper sheet in said localized region when pressure is applied manually on the upper sheet to cause the upper sheet and the base layer to adhere in said localized region.

5. An erasable product according to claim 4, wherein the upper sheet comprises a material selected from the group consisting of transparent and translucent materials.

6. An erasable product according to claim 5, wherein the base layer is continuous over the area beneath the upper sheet where the upper sheet and base layer are releasably adhesive together.

7. An erasable product according to claim 6, wherein the base layer and upper sheet over the base layer are longer than they are wide, and said wipe-start region is provided at one end of the base layer.

8. An erasable product according to claim 7, wherein the width of the base layer and upper sheet are such that the full width of the upper sheet may be separated from the base layer by a single wipe of a user's finger or thumb over the upper sheet.

9. An erasable product according to claim 1, comprising a contrasting icon or indicia which is visible through the upper sheet when pressure is applied manually on the upper sheet to cause the upper sheet and the base layer to adhere and which is substantially less visible when the upper sheet is wiped from said wipe-start region to separate the upper sheet from the base layer.

10. An erasable product according to claim 9, wherein the base layer is formed in the shape of said icon or indicia.

11. An erasable product according to claim 9, wherein the icon or indicia is printed on a surface beneath the base layer and the base layer is applied over said surface as a substantially clear coating.

12. An erasable product according to claim 9, wherein the icon or indicia is printed on the upper sheet as a negative image.

13. An erasable product according to claim 1, comprising an icon or indicia printed on the upper sheet in a color such that when pressure is applied manually on the upper sheet to cause the upper sheet and the base layer to adhere said icon or indicia is made substantially less visible and such that when the top surface of the upper sheet is wiped from said wipe-start region to separate the upper sheet from the base layer said icon or indicia becomes visible.

14. An erasable product according to claim 13, wherein said icon or indicia is printed on an underside of the upper sheet.

15. An erasable product according to claim 14, wherein said icon or indicia is printed as a positive image.

16. An erasable product according to claim 14, wherein said icon or indicia is printed as a negative image.

17. An erasable product according to claim 1 wherein a rear surface of the backing sheet is coated with a contact adhesive.

18. An erasable product according to claim 17, wherein the product is an erasable label.

19. An erasable product according to claim 17, wherein the product is a video cassette label.

20. An erasable product according to claim 17, wherein the product is a computer disk label.

21. An erasable product according to claim 1, further comprising a book having a page, and wherein the base layer is carried by the page and the upper sheet is fixed to the page of the book.

22. An erasable and rewritable label comprising a base layer comprising a releasable adhesive material and an upper sheet extending over the base layer and also over a wipe-start region at one side of the base layer in which wipe-start region the base layer is non-adhesive, which upper sheet is fixed to a backing sheet carrying the base layer about peripheral sides of the upper sheet and the upper sheet providing a smooth and substantially wrinkle free top surface, the upper sheet and base layer being sufficiently releasably adhesive together, other than in said wipe-start region, under pressure applied to the upper sheet by a writing implement to cause the upper sheet and the base layer to adhere in a localized region of said pressure so that color of the base layer is visible through the upper sheet in said localized region, and the upper sheet being movable relative to the base layer to separate the upper sheet and the base layer in the localized region to erase the label when a user's finger or thumb is wiped across the upper sheet to create a wrinkle in the non-adhesive wipe-start region and then move the wrinkle from said wipe-start region to the other side of the label.

23. An erasable and rewritable label according to claim 22, wherein a part of the base layer of the label comprises a contrasting icon or indicia which is visible through the upper sheet when pressure is applied manually on the upper sheet to cause the upper sheet and the base layer to adhere and which is substantially less visible when the upper sheet is wiped to separate the upper sheet from the base layer.

24. An erasable and rewritable label according to claim 22 comprising an icon or indicia printed on the upper sheet as a negative image such that the icon or indicia is visible through the upper sheet when pressure is applied manually on the upper sheet to cause the upper sheet and the base layer to adhere and which is substantially less visible when the upper sheet is wiped to separate the upper sheet from the base layer.

25. An erasable label according to claim 22 comprising an icon or indicia printed on the upper sheet in a color such that when pressure is applied manually on the upper sheet to cause the upper sheet and the base layer to adhere said icon or indicia is substantially less visible and when the top surface of the upper sheet is wiped to separate the upper sheet from the base layer said icon or indicia becomes visible.

* * * * *